United States Patent [19]

Reeder

[11] Patent Number: 4,563,809

[45] Date of Patent: Jan. 14, 1986

[54] FUSE WITH CENTERED FUSE FILAMENT AND METHOD OF MAKING THE SAME

[75] Inventor: Conrad M. Reeder, Prospect Heights, Ill.

[73] Assignee: Littelfuse, Inc., Des Plaines, Ill.

[21] Appl. No.: 448,313

[22] Filed: Dec. 9, 1982

[51] Int. Cl.[4] ..... H01H 69/02

[52] U.S. Cl. ..... 29/623; 337/231; 337/234; 337/238

[58] Field of Search ..... 29/623; 337/234, 228, 337/202, 231, 236, 248, 252, 253, 238

[56] References Cited

U.S. PATENT DOCUMENTS

| | | | |
|---|---|---|---|
| 1,562,985 | 11/1925 | Murray | 337/234 |
| 3,199,773 | 4/1965 | Keeley | 200/120 |
| 3,227,844 | 1/1966 | Burrage et al. | 200/248 |
| 3,683,732 | 8/1972 | Juppet | 226/97 |
| 3,837,624 | 9/1974 | Dandurand | 226/97 |
| 4,158,187 | 6/1979 | Perreault | 337/248 |

*Primary Examiner*—Howard N. Goldberg
*Assistant Examiner*—P. W. Echols
*Attorney, Agent, or Firm*—Russell E. Hattis

[57] ABSTRACT

An improved cartridge fuse has resilient plugs at opposite ends of the fuse housing through which extend a centered fuse filament held in tension by the defining walls of a plug passage hugging the fuse filament to maintain such tension. The fuse filament is placed in the plug passages by means of a needle which is passed through the fuse housing and the plugs therein to create a path for the fuse filament which, when the needle is pulled from the housing, leaves the fuse filament in a tensed centered condition in the fuse housing.

4 Claims, 9 Drawing Figures

FUSE WITH CENTERED FUSE FILAMENT AND METHOD OF MAKING THE SAME

TECHNICAL FIELD OF INVENTION

This invention relates to cartridge fuses, and has its most important but not only application to miniature fuses of the type having a centered fuse filament in a cylindrical insulating housing closed by terminal-forming end caps which surround the housing ends.

BACKGROUND OF INVENTION

In the design and manufacture of cartridge type electrical fuses of the type described among the generally sought objectives are to provide a fuse with a taut, centered fuse filament soldered to the end caps in the most effective and economical manner, with a minimum size for a given specific fuse rating, and minimum explosion risk during blowout involving high short circuit currents at high voltage which produce high energy arcs which can explode the fuse housing. With regard to the explosion risk, in very small fuses a relatively short arc can reach the end caps of the fuse and create an explosion hazard more readily than with larger sized fuses.

One of the most common and simplest, but least reliable, ways to make a miniature cylindrical cartridge fuse is to position the fuse filament diagonally disposed across the length of the cylindrical housing and captively secure the ends of the fuse filament between the outer ends of the fuse housing and the end caps. The physical and electrical attachment of the fuse wire ends to the end caps and the end caps to the housing are obtained by melting a solder pellet placed in each end cap. The solder is generally drawn by capillary action into the small clearance space between the end caps and housing to anchor and seal the end caps.

The blowout characteristics of such fuses tend to vary undesired degree from fuse to fuse because, as the operating currents slowly rises to the melting temperature of the fuse filament, the resulting expansion of the fuse filament can cause portions thereof which are near but spaced from the housing walls to sag and touch portions of the walls of the housing, which modifies the desired blowing characteristics of the fuse due to the heat sinking effect of the housing walls. The degree to which each fuse filament sags and the degree to which the fuse blowing characteristics of each fuse is modified can vary substantially from fuse to fuse. Thus, in the manufacturing process a delicate balance must be struck between the necessity for applying enough tension to the fuse filament during the attachment process to minimize sag, without over-stressing of the fuse filament, which can produce undesired weakening of the fuse or the stretching thereof which also modifies the fuse blowing characteristics.

For the above reasons, it is generally recognized that the better approach for making miniature fuses is to use a fuse design with a fuse filament centered in the fuse housing. However, such a disposition of the fuse filament, while inherently more reliable than the diagonally extending fuse filament as described, is more difficult to assembly and as in the case of fuses with diagonal fuse filaments the tension in the fuse filaments thereof is not readily closely controlled. In one process of fuse assembly having some aspects used also in the present invention, the fuse housing has end caps with centered holes therein, and a fuse filament carried by an insertion pin is passed through the fuse housing and the centered openings of the end caps. An operator then solders the fuse filament to the outer surfaces of the end caps with the fuse filament under manually applied tension. Since it is difficult for a person to accurately control the degree of tension applied to the fuse filament, in some cases inadequate tension and in the other cases excessive tension was applied which either broke the filament or unduly stretched the same, so as to undesirably modify the fuse blowing characteristics thereof.

SUMMARY OF THE INVENTION

According to one of the features of the invention, the fuse filament passes axially through and is suspended between a pair of insulating resilient plugs secured and preferably force-fitted within the fuse housing. The fuse filament is supported with the desired tension by axially opposing tensile stress provided by the two plugs hugging the fuse filament centered in the housing, the fuse filament having a greater diameter than unstressed diameter of the plug passages through which it extends, so as to be compressingly held captive thereby. In the most preferred form of the invention, the plug passages are formed in a manner where, upon destruction of the fuse filament by an expanding arc, the walls of the plug passages completely collapse to seal the passages and quench the arc before it reaches the end caps.

According to another feature of the invention, the ends of the fuse filaments so suspended exit the fuse housing through holes in the end caps of the fuse housing, the intended ends of the fuse filaments being affixed by conventional means, as by solder, to the exterior surfaces of the individual end caps without any need for concern to stress the fuse filament during the soldering operation, since the stress on the critical center portion of the fuse filament is fixed by the resilient plugs.

The resilient plugs described unexpectedly provide an arc quenching function vastly superior to that heretofore provided by a single plug for this purpose. Thus, U.S. Pat. No. 3,199,773, issued Apr. 20, 1965 to Keeley, discloses the use of a single arc-quenching plug supporting only one end portion of a fuse filament extending centrally through a fuse housing so that the plug serves no tension control function, the other end of the fuse filament exiting the housing end cap. When the arc reaches the point where the plug surrounds the fuse filament this arc-quenching plug will collapse around the burning fuse filament to quench the arc, as in the case of the insulating plugs of the invention. It was heretofore routinely believed that the use of a single plug of this type would be an adequate arc-quenching preventing means, since the interruption of an arc at any point would interrupt the entire arc. Unexpectedly, as will be more clearly explained, vastly superior arc-quenching characteristics have been obtained when a plug operating in this manner is placed at both ends of the fuse housing as in the case of the present invention. The fuse filament of the present invention thus has the double function of providing a controlled tension on the fuse filament and acting as vastly improved arc-quenching means.

There are fuses of the prior art which utilize insulating plugs in the opposite ends of the fuse housing through which a centered fuse filament extends, but these plugs do not serve a tension-producing function, and no arc-quenching function is disclosed therein. Thus, U.S. Pat. No. 3,227,844, issued to Burrage et al, on Jan. 4, 1966, discloses a fuse with a fuse filament passing centrally through the fuse housing and loosely through much larger passages of a pair of insulating plugs disposed at the ends of the fuse housing. The fuse filament is bent over the insulating end plugs to be secured to subsequently inserted end caps by soldering, spot welding or the like. Manifestly, since the defining walls of the passages in the insulating end plugs which surround the ends of the fuse filament do not hug the same, the insulating end plugs do not act as a tensioning means for the fuse filament.

U.S. Pat. No. 4,158,187 issued June 12, 1979 to Perreault discloses a fuse of the type having a diagonal fuse filament bent around the ends of the cylindrical housing closed by metal end caps extending around the outside of the housing ends. Instead of using a solder pellet to secure the fuse filament to the end caps and the end caps to the housing, the end caps are engaged into recessed portions of the fuse housing. The end caps are held in a stabilized position in a longitudinal direction by pressable, resilient, disk-shaped members disposed between the end caps and the outer edges of the housing. While the ends of the diagonally disposed fuse element are engaged by the resilient members' resilient force against the ends of the housing, there is no appreciation disclosed in this patent for utilizing this resilient force of the resilient members against the fuse filament as a means for rapidly quenching any arc which develops in the fuse.

The fuse construction of the invention above described lends itself to a unique process of making the same. Thus, according to a broad method aspect of the invention, a fuse filament is properly centered under a desired tension within the fuse housing where the fuse filament passes through the resilient plugs as described by a method wherein, after the resilient plugs have been inserted and the ends of the housing in the end caps suitably secured over the ends of the housing before the fuse filament has been placed therein, a needle having a piercing front end is passed completely through the end housing and the centered holes in the end caps. The needle thus pierces the resilient plugs. A fuse filament, having a length greater than the length of the fuse housing with end caps attached thereto, is then made to transverse the path through the fuse formed by the needle. This can be accomplished in one of two ways, one of which is the applicant's invention, and the other of which is a later invention of John Petkunas. In accordance with the applicant's invention, the piercing end of the needle has an opening therein which receives the fuse filament after the needle is extended through the fuse housing. The needle is then withdrawn from the fuse housing, and in the process of so doing the fuse filament is drawn through the fuse housing and the apertures in the resilient plugs formed by the piercing end of the needle when it is initially inserted into the fuse housing. The hugging friction of the resilient plugs on the fuse filament keeps the fuse filament taut and centered. In the other form of the invention, which is a sole later invention of John Petkunas, the needle is hollow. After the hollow needle is extended through the fuse housing to pierce the resilient plugs, a fuse filament longer than the fuse housing with the end caps thereon is then passed through the hollow needle. The hollow needle is then withdrawn over the fuse filament, which is held in place by the gripping action of the resilient plugs as the needle recedes from the fuse filament on being withdrawn from the fuse housing.

DESCRIPTION OF INVENTION

Figure 1:
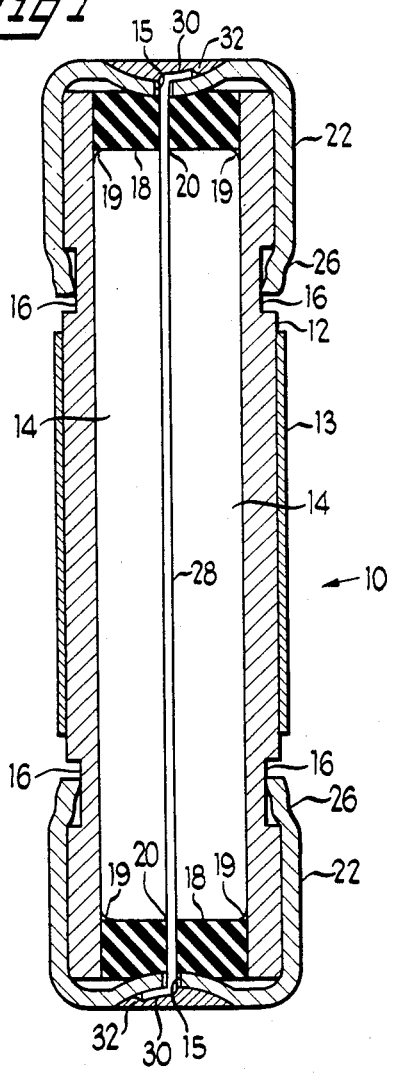
FIG. 1 is a cross section view of an assembled cartridge fuse according to the present invention.
Figure 2:
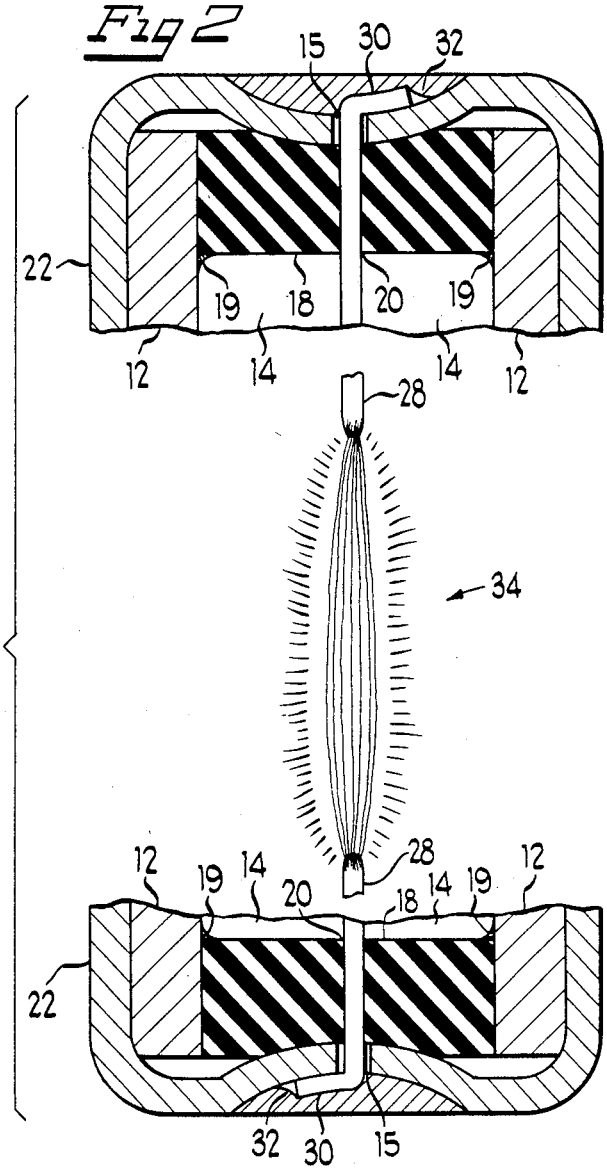
FIG. 2 is a fragmentary cross section view of the region of the end caps of FIG. 1, with a central arc shown centrally disposed between to represent the burnout process in the initial stages.
Figure 3:
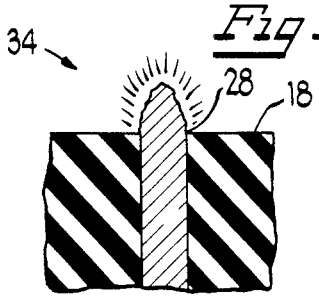
FIG. 3 is a partial cross section view of the region of the end of the burning arc of FIG. 2 as the fuse element retreats toward the lower sealing plug.

FIG. 1 shows an improved cartridge fuse assembly 10, comprising of a central fuse filament 28 coaxially disposed in a cylindrical fuse housing 12. Two resilient cylindrically configured end plugs 18 are secured at either end of a linear central passageway 14 of the housing 12, preferably by adhesive means indicated by fillets 19, so as to be sealed to the interior walls of the linear central passage. In the preferred embodiment of the invention the end plugs 18 are made of silicone rubber sealed to the interior walls of the linear fuse housing passageway 14 by silicone rubber cement. The ends of the fuse filament 28 are held captively secured in light tension in the central plug passages 20 by means which will subsequently be discussed. Two cylindrical conducting end terminal caps 22, each having a central passage 15, are secured to the fuse housing 12 by means of integral shoulders 26 extending inward to engage retaining grooves 16 on the outer surface of the fuse housing. The central fuse filament 28 passes loosely through the end cap passages 15, the ends 30 of the fuse filament being folded over the end caps 22 to be secured to each, most preferably by solder means exemplified by fillets 32. A label 13 secured to the outer surface of the fuse housing 12 is attached for purposes of bearing the amperage and voltage rating legends characterizing the fuse.

The resulting fuse cartridge 10 thus holds the central fuse filament 28 centrally aligned down the central housing passageway 14 sealed by the end plugs 18, the end plugs also providing the total tensile support for the central region of the fuse filament. Since the fuse ends 30 exit through loosely fitting end cap passages 15 to be secured to the end caps 22, no undue stress is placed on the fuse element during the lead attachment process, thereby improving manufacturing yields and preserving a high degree of alignment. The region of the central housing passageway 14 between the end plugs 18 may be filled either with a chosen gas, or with suitable filler materials such as powered silica or powdered gypsum. Such fillers are known in the art for their properties of improving the high current blowing properties by providing substantial arc quenching action to inhibit explosive rupture of the fuse with its associated danger to associated equipment, as well as to personnel. As will subsequently be discussed, the structure shown in FIG. 1 is particularly adapted to ease of manufacture, particularly by automatic machinery.

By providing an insulating resilient plug 19 at each end of the structure, and by providing a narrow fuse filament passage 20 in each plug which hugs the fuse filament, an unexpected improvement in arc quenching characteristics was secured over more conventional fuse structures, such as shown in the previously mentioned Keeley patent, wherein only one end of a fuse element is so confined.

For this reason, various arc quenching means have been routinely applied to miniature fuses, such as filling the same with sand or other materials, or using a single resilient plug as in said Keely patent. Viewed analytically, it should only be necessary to quench the arc at one point, since breaking the circuit at any point extinguishes the arc. Thus, if the fuse in FIG. 1 were provided with only one such constricting passage at one end of the structure, one would expect that the quenching action would be sufficient to prevent explosive failure of such a fuse.

Experimentally, however, a completely different effect has been observed. Cartridge fuses with a single constricting passage at one end failed disastrously and with explosive violence under test at 625 volts at a current of 10,000 amperes. It was unexpectedly discovered that fuses provided with confining plugs at both ends of the fuse, as shown in FIG. 1, will routinely withstand up to 200,000 amperes without explosion under similar test conditions. Accordingly, a principal feature of the present invention is the provision of two such entrainment plugs, one at either end of a captive fuse element.

Figures 5, 5A, 6, 7, 8:
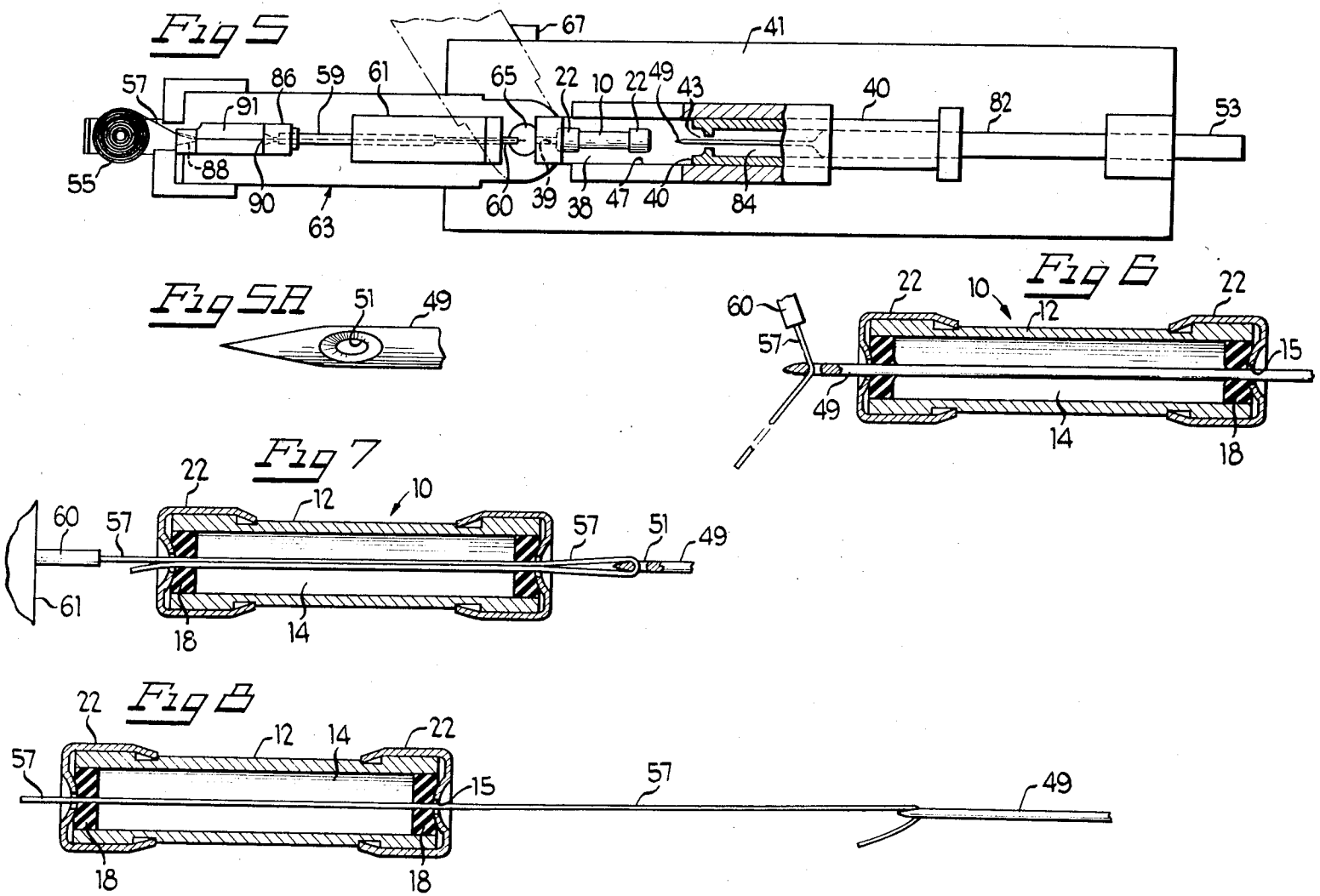
FIG. 5 is a partially sectioned plan view of one embodiment of an assembly method for the fuse cartridge of FIG. 1, showing a pivotable dispenser arm orientable to two positions for the fabrication process, a threading needle being shown in the retracted position.
FIG. 5A is an expanded fragmentary view of the tip of the needle of FIG. 5.
FIG. 6 is a partially cross sectioned fragmentary view of portions of the apparatus of FIG. 5 with the needle inserted completely through the fuse body and capturing a threaded length of fuse element.
FIG. 7 is a partially cross sectioned view of the region shown in FIG. 6 showing a fuse loop element drawn partially through the fuse cartridge and still threaded to the withdrawing needle.
FIG. 8 is a similar view of the fuse cartridge of FIG. 7 after needle withdrawal, showing the fuse element nearly disengaged from the needle.

FIGS. 5–8 show one method for the fabrication of the fuse cartridge 10 of FIG. 1. In FIG. 5 the fuse cartridge 10 with resilient plugs and end caps in position is secured in position by a fuse cradle 38 having an axial cradle passage 39 at one end, and by a movable slide 40 having a corresponding passage 43. The cradle 38 is fixedly attached to a mounting platform 41, the slide 40 being movable in guide passage 47 to the left to capture the right end of the fuse cartridge 10, or alternatively to a disengaged position to the right for loading and unloading cartridges into or from the cradle 38. An axially disposed needle 49, similar to a sewing machine needle, and having a transverse needle passage 51 through the piercing front end thereof (See FIG. 5A), is mounted on the end of a piston 82 slidably mounted within a piston guide passage 84 coaxially disposed within the slide 40. By grasping handle 53 at the end of the needle 49 and forcing the needle to the left, the needle enters the passage 15 of the right hand terminal of the fuse cartridge 10, piercingly entering successively the right plug 18 and left plug 18, exiting the fuse body via the passage in the left end cap 22 as shown in FIG. 6. Thus, the needle 49 projects axially clear through the fuse body 10, with the piercing front end projecting from the fuse housing as shown.

A support arm 63 of the apparatus of FIG. 5 is pivotably supported about a pivot 65, and carries bulk fuse filament stock 57 dispensed by a rotary dispensing spool 55. With the support arm 63 disposed as shown by the dotted lines of FIG. 5 the fuse filament stock 57 is fed through a threading guide 86 having guide passages 88 and 90 at either end and a cutaway portion exposing the filament stock to manual access therebetween to allow the operator to feed the fuse filament 57 along the guide system. The filament stock 57 then enters a feed tube 59 supported on a tube support 61, a length of fuse filament stock being threaded through the needle end passage 51 as shown in FIG. 6, leaving an extending length substantially greater than the length of the fuse body 10.

The support arm 63 is then rotated to the left as indicated in FIG. 5 by the solid lines, placing the wire feed tube in closer alignment with the needle axis, at which point the needle 49 is withdrawn to the right, thereby drawing a loop of fuse element stock 57 completely through the cartridge 10 as shown in FIG. 7. Symmetry of gripping force by the resilient plugs 18 and the sharp bend of fuse element stock 57 around the needle end passage 51 cause the loop of fuse element stock to pass without difficulty through the cartridge 10 as shown.

Further withdrawal of the needle 49 causes the free end of the fuse element stock 57 to exit the right plug 18 of FIG. 8, at which point the gripping force on this end is lost, whereupon further withdrawal of the needle causes the free end to pay out through the needle end passage 51 as shown. At this point assembly is substantially complete, there remaining only the elementary step of cutting the extending lengths of fuse element stock 57 away from the end caps 22 and soldering them into position to the configuration shown in FIG. 1.

Figure 4:
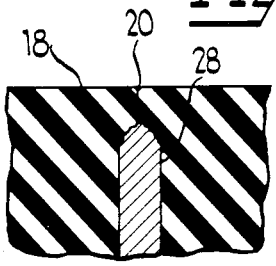
FIG. 4 is a view similar to FIG. 3 showing the sealing action of the end plug around the arc region after the fuse element has burned a distance below and into the lower end plug.

It will be appreciated that by this method the plugs 18 in FIG. 1 have been radially expanded about the inserted fuse filament 28, and therefore will provide local radial stress to secure the filament in position, as well as to provide the previously mentioned pinch-off effect when the arc attempts to penetrate the plug as shown in FIG. 4.

An alternative fabrication method (not shown), which is the sole invention of John Petkunas employs a needle having an axial passage, so that a length of fuse stock may be passed through the length of the needle after insertion to leave a free end of stock extending from the needle. By withdrawing the needle while holding the free end of the fuse element stock captive, the plugs again expand inwardly to seize the stock and secure it in position, as in the first method.

Thus, there has been described a cartridge fuse design, and an associated method of manufacture therefor, resulting in a fuse having greatly improved explosion resistance under high power dissipation blowout conditions, a properly centered central fuse element disposed axially in the fuse body passage to provide more uniform blowing properties than is conventionally encountered with off-center fuse element, and low stress attachment means for the fuse element ends to the fuse element terminals. Both the fuse structure itself, and the associated manufacturing methods are simple and inexpensive, and lend themselves readily to mass fabrication techniques requiring no delicate fuse element attachment or end terminal attachment processes requiring delicacy of alignment or tension. In particular, the resulting cartridge fuses having a pair of seal-off-insulating plugs at both ends result in a fuse of reasonable length capable of withstanding very high short circuit currents without undergoing explosive disintegration.

While the invention has been particularly shown and described with reference to a preferred embodiment thereof, it will be understood by those skilled in the art that various changes in form and details may be made therein without departing from the spirit and scope of the invention.

I claim:

1. A method for manufacturing electrical cartridge fuses having an insulating housing with a linear passageway therethrough for accommodating an axially disposed fuse filament therein, and end walls on the housing having centered holes therein through which said fuse filament extends, said method comprising:

providing a pair of solid resilient members configured to fit into said housing passageway;

securing said members within opposite end portions of said housing passageway;

providing a length of a fuse filament greater than the length of said housing;

passing the piercing front end of a needle completely through and beyond the housing so it passes through said end wall holes and pierces said resilient members; and causing said fuse filament to traverse the path through said fuse formed by the needle and removing the needle from the housing so that the fuse filament extends through and beyond the ends of the fuse, said pair of resilient members collapsing around and resiliently capture portions of said fuse filament and hold the same taut and centered in said housing.

2. The method of claim 1 wherein said piercing front end of said needle has a fuse filament receiving means, and after said needle is passed through said fuse housing said fuse filament is attached to the fuse filament receiving means on the piercing end of the needle, said needle being thereafter withdrawn from said fuse housing so that said needle pulls a length of said fuse filament along with it in a taut condition to thread said fuse filament through said fuse housing end walls and resilient plugs, the passages formed by said needle in said plugs hugging said fuse filament to hold the same taut in said housing.

3. The method of claims 1 or 2 which said end walls of said housing are parts of electrically conducting end caps on the ends of the housing, said fuse filament being mechanically and electrically connected to the outer faces of said conducting end caps.

4. The method of claim 2 wherein said fuse filament receiving means associated with said needle is a transverse hole in the front end thereof, said fuse filament material is stored in bulk form in a movable dispenser, said dispenser having dispensing guide means for dispensing a given length of fuse filament approximately along a chosen defined dispensing axis, said method further including the steps of first moving said dispenser to align said dispensing axis first approximately along the axis of said transverse hole in said needle, dispensing said fuse filament through said hole, next moving said dispenser to align said dispenser closer to the axis of said needle and then withdrawing said needle through the fuse to pull said fuse filament through said housing.

* * * * *